United States Patent [19]

Whitman

[11] Patent Number: 4,604,259

[45] Date of Patent: Aug. 5, 1986

[54] PROCESS FOR MAKING COPPER-RICH METAL SHAPES BY POWDER METALLURGY

[75] Inventor: Charles I. Whitman, Bay Village, Ohio

[73] Assignee: SCM Corporation, New York, N.Y.

[21] Appl. No.: 777,768

[22] Filed: Sep. 19, 1985

Related U.S. Application Data

[63] Continuation-in-part of Ser. No. 540,973, Oct. 11, 1983, abandoned.

[51] Int. Cl.[4] ..... B22F 7/00

[52] U.S. Cl. ..... 75/247; 419/2; 419/22; 419/23; 419/28; 419/36; 419/37; 419/38; 419/57; 419/58; 419/59; 419/65; 419/66; 75/133

[58] Field of Search ..... 419/36, 37, 28, 2, 22, 419/23, 38, 57, 58, 59, 65, 66; 423/604; 75/247, 133

[56] References Cited

U.S. PATENT DOCUMENTS 4,315,777 2/1982 Nadkarni et al. ..... 419/19 X

*Primary Examiner*—Stephen J. Lechert, Jr.

*Attorney, Agent, or Firm*—R. A. Sturges

[57] ABSTRACT

A copper-rich metal shape is produced by forming a coherent forerunner shape consisting essentially of cupreous powder, said powder containing a proportion of copper oxide sufficient for facilitating the obtaining of a high sinter density in sintered porous mass, and in a reducing atmosphere at temperature that will sinter copper present, converting said forerunner shape into a porous sintered mass virtually devoid of copper oxide. Said porous mass can be worked so virtually full density if desired.

10 Claims, No Drawings

PROCESS FOR MAKING COPPER-RICH METAL SHAPES BY POWDER METALLURGY

RELATED APPLICATION

This application is a continuation in part of U.S. Ser. No. 540,973 filed Oct. 11, 1983 now abandoned.

This invention relates to an improved process for producing metal shapes, i.e., forms, pieces, parts, and the like, and more particularly to such process using powder metallurgical technique with cupreous powder.

BACKGROUND OF THE INVENTION

Clean elemental copper powder can be formed, as by pressing, into a coherent "green" shape. Such shape then can be sintered and the sintered shape repressed to yield a substantially fully dense copper shape. Copper metal powder that has an oxidized surface is deoxidized prior to such a sequence.

Another conventional powder metallurgical process for making a copper metal shape comprises oxidizing small elemental copper pieces such as shot with air at elevated temperature to form preponderantly cuprous oxide, reducing the ground oxide to elemental copper, pressing the ground reduced copper into a cohesive mass, sintering that mass, and repressing the resulting sintered mass into final shape and density.

In the above-described operations the conventional sintering of a "green" copper powder shape or part often tends to isolate internal porosity, probably by closing off small channels in the "green" part undergoing sintering, thereby restricting ready attainment of high density in the sintered mass. Advantages of the instant invention over conventional powder metallurgy operations like those described above include opportunities for realizing greater economy, for avoiding contamination, and, most surprisingly, for enhancing the sintering.

BROAD STATEMENT OF THE INVENTION

Broadly the instant invention is a process for the production of a metal shape. It comprises: forming a coherent forerunner shape consisting essentially of cupreous powder, said powder containing a proportion of copper oxide sufficient for facilitating the obtaining of high sinter density in the porous sintered mass made in a step that follows; and, in a reducing atmosphere at temperature that will reduce the copper oxide and sinter copper present, converting said forerunner shape into a porous sintered mass virtually devoid of copper oxide.

DETAILED DESCRIPTION OF THE INVENTION

This process is suitable for making discrete simple or intricate parts or pieces of metal as well as continuous or semi-continuous sheet, rod, wire and the like. Frequently the forerunner shape can be substantially different from the conformation of the ultimate metal part because of loss of oxygen, densification upon sintering, ultimate consolidation, and any special reshaping that is done in such ultimate consolidation.

The generally preferable way of practicing the instant invention is to form a forerunner shape that consists essentially of coherent copper oxide powder as the cupreous powder starting material, then perform the conversion called for herein. Another way is to use as the cupreous powder starting material an intimate blend of copper oxide powder and elemental copper powder, or to use elemental copper powder having appreciable surface oxidation, so that there is enough copper oxide to facilitate obtaining high sinter density in the sintered mass made by such conversion, form the forerunner shape, then perform such conversion.

Advantageously the pulverulent copper oxide for the instant process contains at least about 80% cuprous oxide by weight; preferably the cuprous oxide content is 90% or higher. While coarser copper oxides can be used, the preferred cuprous oxide has particle size fine enough to all pass through a 325-mesh U.S. Standard sieve. Clearly, the higher the purity of the starting materials for the practice of the instant invention, the purer can be the metal piece resulting therefrom. Use of cupric oxide as the copper oxide starting material also is possible although it requires more reduction. Thus, in said generally preferable way of practice it is usually advantageous to limit the presence of cupric oxide to about 8–10% of the copper oxide starting material. In this connection also the pulverulent copper oxide starting material also can contain elemental copper metal in very minor proportion, typically 1–10% and usually about 1–3% of the cupreous starting material. Where the powdered cupreous starting material is richer in elemental copper as, for example, when an elemental copper powder such as an atomized copper powder has appreciable surface oxidation, or when elemental copper powder is blended in high proportion with a copper oxide powder such as a cuprous oxide-rich one, it is desirable to use such copper oxide proportion on the order of a tenth of the cupreous powder starting material and usually about a quarter to a third or more for obtaining readily a desirably high density in the resulting porous sintered mass.

While this application is addressed primarily to the manufacture of elemental copper shapes from powdered copper oxide or powder mixtures of copper oxide with elemental copper as the cupreous starting material, it should be understood that: the cupreous powder starting material can contain other finely divided material in minor proportion alloyable within the solubility range of copper under the conditions ensuing, which material will act to alloy with the elemental copper present under the conversion conditions herein; and that any elemental copper in the starting material can have prealloyed therewith one or more elements to constitute, for example, a powdered bronze or brass. Thus, it is possible to have as a minor proportion, ordinarily not more than about 10–15% and often as little as ½%, of such cupreous starting material, powdered substances such as lead, nickel, tin, iron (which is very limited as to its solubility in copper), phosphorus, and/or zinc, and/or compounds containing such elements that will be reduced and alloy with the copper such as an oxide that will be reduced along with the copper oxide as necessary to leave a reduced elemental residue that alloys with copper under the conversion conditions called for herein. It also is possible to have blended with the cupreous staring material a minor proportion of powdered refractory substance, e.g., an oxide, carbide, boride, or nitride, for imparting frictional or wear resistance or other property, typically silicon carbide or nitride, or alumina. These survive in the process as inclusions in a substantially completely deoxidized elemental copper-rich matrix.

For most applications the particles for the forerunner shape are mixed with fugitive binder that promotes cohesion of such shape upon its forming because the presence of oxides such as a copper oxide, especially appreciable surface oxide on metal particles, tends to decrease cohesion of the green part markedly. Such binder can be fluent, pasty or powdery at room temperature, inorganic or metal organic (such as a copper soap, aqueous cupric acetate solution, or aqueous amminecopper II acetate solution) and/or organic (such as a resin or resinous solution).

A fugitive binder for the instant purpose is one that volatilizes, burns off, pyrolyzes, decomposes into escaping gaseous components, or undergoes any combination of these changes to become virtually entirely if not entirely removed from the forerunner shape being processed. The function of such binder is to hold the forerunner shape together as a cohesive mass for shaping and handling the resulting forerunner shape. Sintering develops much stronger cohesion for subsequent working. The transition from the initial forerunner shape to a porous sintered elemental copper shape in the process is accompanied by escape of vapors, e.g., from binder and/or residues thereof being vaporized, pyrolyzed, and/or oxidized. Reduction of oxides such as copper oxide to copper metal and sintering of metal present ensues. Sintering takes place at temperature below melting point of the cupreous particles present where diffusion of copper occurs across contact area.

Advantageously the proportion of binder should be maintained as low as possible for achieving necessary cohesion of the forerunner shape; this is to limit cost and waste, and to maximize efficiency of operation. Typically such binder proportion advantageously is no more than about 5–20% by weight of the cupreous starting material, and preferably it is about 1–3% or even less. Because of their tendencies to be desirably fugitive in process with the leaving of inconsequential residue at most, aliphatic compounds, particularly waxy aliphatic hydrocarbons and halocarbons and mixtures of same, are preferred. Also suitable for the instant use are various acrylic resin binders including polymers or copolymers having a large proportion of methyl methacrylate units; methacrylates tend to depolymerize at a fairly low temperature. While thermoplastic polymers and resinous materials are convenient to use, the binder also can be thermosetting, for example, a blocked aliphatic isocyanate resin that is heat-deblocked and reacted with an hydroxyacrylate-containing resin in the forming of the forerunner shape. Conventional plasticizers and/or solvents can be used in the resinous binder where necessary or desired. Where the starting cupreous powder is moist, it often can be advantageous to dry it. Where the binder contains water or a volatile solvent, it usually is advantageous to dry the forerunner shape non-disruptively (gradually) as an initial operation of binder removal.

Forming the forerunner shape conveniently can be done by pressing as in a die. Advantageously, this is done at modest pressure, e.g., at about 1,000–1,800 kilograms per square centimeter (with quick ejection) to suppress lateral crack formation. Other forerunner shape-forming methods such as extrusion, rolling or injection molding can be used.

Conversion of a forerunner shape into a porous sintered mass of elemental metal can be performed in a single apparatus such as a furnace or in a succession of apparatus. The high temperature reached in the instant conversion operation (hot zone) should not reach the melting point of copper (or any copper alloy present or being formed in substantial proportion). It will be between about 760° and about 1075° C., preferably between about 950° and about 1010°. The atmosphere in the apparatus is rich in reducing gas components. The total pressure advantageously is practically atmospheric (although subatmospheric and modest superatmospheric pressure—up to several atmospheres—could be used, if necessary or desired). Heat up to the hot zone temperature advantageously is gradual to avoid disruption of the forerunner shape as vapors escape therefrom. Conventional equipment with gas supply and exhaust means can be used such as a horizontal traveling belt furnace or a batch-type furnace, both operated at very slight positive pressure. The time of such operation should be sufficient for completing all aspects of the conversion to the extent required (normally to virtually 100% removal of binder, virtually complete reduction of metal oxides present (other than refractories such as alumina or silica) to elemental metal, e.g., copper oxide to copper, and changing of the initially-bound forerunner shape into a porous sintered shape). About a half-hour to an hour ordinarily is allowed for this although it can be longer if needed as when some nickel is present. Generally, it is desirable to have no more than about 500–800 ppm oxygen in a finished elemental copper part. A sintered part that is virtually devoid of copper oxide can be reckoned here as one that has no more than 1,000 ppm oxygen from unreduced copper oxide remaining in it.

In the conversion operation the initial temperature (e.g., a preheating zone) can be quite low, e.g., 100° to dry a green forerunner shape or "perform", but more often the initial temperature of such preheating zone will be about 20°–400° C. because such preform preferably is ostensibly dry for efficiency and economy. The temperature of the conversion is increased from preheat temperature continuously or in one or more increments to about 760° to a temperature below the melting point of copper (1083° C.) (preferably to about 950°–1010° C.) for ultimate sintering. This most conveniently is done by moving the forerunner shape in process from zone to zone in the same or a succession of apparatus.

For safety and simplicity a reducing atmosphere is used throughout, although driving off of water or solvent at fairly low temperature, e.g., 100°, from a freshly-made forerunner shape (preform) could be in an inert gas atmosphere (e.g., nitrogen) or even in one containing some molecular oxygen, e.g., that admitted from surroundings.

Typically the atmosphere for the conversion operation is rich in molecular hydrogen, e.g., from the input to a conversion furnace of straight hydrogen gas, dissociated ammonia, or other molecular hydrogen supply. While carbon monoxide, methane, and other conventional gaseous reductants could be used, they generally are avoided to preclude their leaving any carbon residue about.

The resulting product is a porous sintered elemental metal shape normally having a density of at least about 75% (and generally substantially more) of the theoretical sintered density of the metal shape (which is reckoned for elemental copper at 8.92 gms./cc.). As noted above, conventional sintering of pressed copper powder parts often tends to isolate internal porosity by closing off small channels in the part undergoing sintering, thus limiting the attaining of desirably high sinter densities readily. By way of contrast the instant invention surprisingly can produce the high sinter densities in the porous part quite readily. Apparently there is less isolation of internal porosity in the instant process that process than in the conventional ones.

The porous sintered elemental metal shape generally will be further consolidated, usually to essentially full density (which for elemental copper is reckoned at 98% or more of 8.92 gms.cc.). Consolidation can be done for example by pressing, rolling, swaging, forging, and/or extruding in one or more stages. Generally such further consolidation is done as a cold process, that is at a temperature not exceeding about 100° C. The consolidation can be done in connection with a special forming operation (such as where the porous sintered metal shape is first pressed into a solid piece like a cylinder and then such piece is back-extruded in a second pressing operation to yield a hollow member).

The following examples show ways in which this invention has been practiced, but should not be construed as limiting it. In this specification all parts are weight parts, all percentages are weight percentages, and all units are in the metric (cgs) system unless otherwise expressly indicated.

EXAMPLES

Cylindrical slugs were pressed from cupreous powder and binder at 4,218 kgs./sq. cm. Each slug weighed 30 gms. and was 1.62 cm. in diameter by 3.0 cms. long. The cupreous powder used was a commercial copper oxide powder, 95% of which would pass a 325-mesh U.S. Standard sieve; its specification was 91–95% $Cu_2O$, 2–8% CuO, and 1–3% $Cu^o$, and it contained less than 1% impurities. Such cupreous starting material was in an intimate blend with a white powdery polymer binder in the proportion of 100 parts of the cupreous powder per part of said binder. The binder was a dry mixture of polyethylene and polytetrafluoroethylene that was nominated "MP22XF", solid by Micropowders Incorporated, Yonkers, N.Y. Each slug was converted into a porous sintered mass at essentially atmospheric pressure (actually at a very slight positive pressure for safety) in a laboratory furnace charged with hydrogen gas.

In the first two examples the furnace used was an electrically-heated tube furnace fed into one end with hydrogen; exhaust fumes were withdrawn from the other; the slug was placed in a nickel boat that was moved within such tube furnace periodically. Each slug of the last three examples was run continuously through an electrically-heated belt furnace on a horizontal traveling belt. Hydrogen entered the center, and exhaust fumes were withdrawn from each end. Both kinds of furnaces had a zone of maximum temperature ("hot zone") as well as a preheating zone or area wherein temperature reached about 316°, then ascended gradually to hot zone temperature.

The sintered slugs were repressed to ultimate shape in two stages. For Examples 2–5 the first stage of the repressing was at a lower pressure to form a solid cylinder. The second stage was at a higher pressure to back-extrude the copper into the shape of a hollow cylinder with a thick bottom that had a small recess central to the inside of the bottom (basically a shape suitable for a female resistance welding electrode cap). In the first Example such repressing pressures were the same but that operation otherwise resembled Examples 2–5.

In the first example the temperature was staged by positioning the boat in the furnace first at a spot for preheating where a thermocouple indicated the lower temperature tabulated below, then at a second spot (hot zone) where a thermocouple indicated the higher temperature tabulated below. In the second example the temperature of the slug was raised slowly stepwise from room temperature to the maximum sintering temperature tabulated, this by advancing the loaded boat from its entry into the furnace until its departure from the hot zone in increments of about 2.54 cms. per five-minute interval over a period of one hour. In the last three examples the belt furnace was used wherein the steadily-traveling slugs took an hour of travel from their entry into the preheat zone until their leaving the hot zone. The amount of oxygen in the finished copper parts was estimated to be no more than about 200 ppm, indicating the virtually complete reduction of oxides used.

The tables below summarize the conditions and results. To be noted specially is the relatively high sintered density of the porous sintered shapes (shown in the last two columns of Table I) attained readily by the exemplary processing sequences. These compare advantageously with the generally lower sintered density ordinarily attained in a conventional pressing of elemental copper powder using corresponding pressing and sintering conditions.

TABLE I

| | Data on Making Porous Sintered Shapes | | | | |
|---|---|---|---|---|---|
| Example No. | Density of Freshly-Made Slug ("Green" Density g./cc.) | Percentage of Theoretical Green Density (Percentage of 6.0 g./cc.) | Sinter Operation | Sintered Density (g./cc.) | Percentage of Theoretical Sintered Density (Percentage of 8.92 g./cc.) |
| 1 | 4.83 | 80.5 | Tube furnace initially for 30' at 371° then for 30' at 999° | 8.63 | 96.7 |
| 2 | 4.73 | 78.8 | Tube furnace Slug advanced 2.54 cms. at 5' intervals for an hour. Hot zone at 999° | 7.45 | 83.5 |
| 3 | 4.83 | 80.5 | Belt furnace with 982° hot zone | 6.93 | 77.7 |
| 4 | 4.84 | 80.7 | Belt furnace with 982° hot zone | 7.23 | 81.1 |

TABLE I-continued

| Example No. | Density of Freshly-Made Slug ("Green" Density g./cc.) | Percentage of Theoretical Green Density (Percentage of 6.0 g./cc.) | Sinter Operation | Sintered Density (g./cc.) | Percentage of Theoretical Sintered Density (Percentage of 8.92 g./cc.) |
|---|---|---|---|---|---|
| | Data on Making Porous Sintered Shapes | | | | |
| 5 | 4.74 | 79.0 | Belt furnace with 982° hot zone | 7.98 | 89.5 |

*Validity of this measurement was questioned so another slug was sintered the same way and its sintered density was 92.6% of this theoretical.

TABLE II

| Example No. | Stage I Pressure (Kg./sq. cm.) | Stage II Density (Kg./sq. cm.) | Final Density (g./cc.) | Percentage of Theoretical Final Density (Percentage of 8.92 g./cc.) | Comment |
|---|---|---|---|---|---|
| | Data on Repressing the Sintered Shapes | | | | |
| 1 | 11,248 | 11,248 | 8.85 | 99.2 | Recess on inside bottom incompletely formed |
| 2 | 8,436 | 12,654 | 8.83 | 99.2 | Recess on inside bottom incompletely formed |
| 3 | 5,624 | 14,060 | 8.84 | 99.1 | Cap completely formed |
| 4 | 8,436 | 14,060 | 8.82 | 98.9 | Cap completely formed |
| 5 | 11,248 | 16,872 | 8.86 | 99.3 | Cap completely formed |

Subsequent experiments were run in substantially the same way except that the pressure used for the pressing out slugs was reduced to 1,125–1,687 kgs./sq. cm. from 4,218 kgs./sq. cm. These subsequent "green" slugs were removed rapidly fromthe mold. They had less tendency to delaminate than did the green slugs pressed at 4,218 kgs./sq. cm., therefore less propensity for developing interior lateral cracks in the finished work.

What is claimed is:

1. A process for the production of a metal shape which comprises the steps of:

(a) forming a coherent forerunner shape consisting essentially of cupreous powder containing at least about 80% by weight of copper oxide and from 1% to 20% by weight of a fugitive binder, (b) contacting said forerunner shape with a reducing atmosphere, and (c) elevating the temperature of said shape in said atmosphere to from about 760° C. to a temperature below the melting point of copper, whereby said binder is removed, the copper oxide is reduced to copper metal and the copper metal is sintered to form a porous sintered mass of copper substantially free of copper oxide.

2. The process of claim 1 wherein the forerunner shape is heated gradually to a temperature of about 760°–1075° in the presence of molecular hydrogen reductant.

3. The process of claim 2 wherein said temperature is about 950°–1010°.

4. The process of claim 1 wherein said copper oxide consists essentially of cuprous oxide.

5. The process of claim 1 wherein said binder constitutes not substantially more than about 5% by weight of said forerunner shape.

6. The process of claim 1 wherein said forerunner shape contains elemental copper.

7. The process of claim 1 wherein said binder comprises a polymer.

8. The process of claim 1 wherein said porous sintered mass is worked to substantially full density.

9. A porous elemental copper-rich shape, the product of the process of claim 1.

10. A substantially fully dense elemental copper-rich shape, the product of claim 8.

* * * * *